US005975994A

United States Patent [19]

Sandhu et al.

[11] Patent Number: 5,975,994

[45] Date of Patent: Nov. 2, 1999

[54] METHOD AND APPARATUS FOR SELECTIVELY CONDITIONING A POLISHED PAD USED IN PLANARIZNG SUBSTRATES

[75] Inventors: Gurtej Singh Sandhu; Trung Tri Doan, both of Boise, Id.

[73] Assignee: Micron Technology, Inc., Boise, Id.

[21] Appl. No.: 08/873,059

[22] Filed: Jun. 11, 1997

[51] Int. Cl.[6] ..... B24B 1/00

[52] U.S. Cl. ..... 451/56; 451/443; 451/444; 451/287

[58] Field of Search ..... 451/56, 21, 60, 451/287, 288, 443, 54, 444, 57, 285, 289; 15/21.1, 39.5, 88.2, 209.1, 230; 134/34, 93, 172, 198, 902

[56] References Cited

U.S. PATENT DOCUMENTS

| | | | |
|---|---|---|---|
| 4,954,142 | 9/1990 | Carr et al. . | |
| 5,081,051 | 1/1992 | Mattingly et al. . | |
| 5,084,071 | 1/1992 | Nenadic et al. . | |
| 5,216,843 | 6/1993 | Breivogel et al. . | |
| 5,245,790 | 9/1993 | Jerbic . | |
| 5,246,884 | 9/1993 | Jaso et al. . | |
| 5,310,455 | 5/1994 | Pasch et al. . | |
| 5,324,381 | 6/1994 | Nishiguchi . | |
| 5,395,801 | 3/1995 | Doan et al. . | |
| 5,407,526 | 4/1995 | Danielson et al. . | |
| 5,433,651 | 7/1995 | Lustig et al. . | |
| 5,439,551 | 8/1995 | Meikle et al. . | |
| 5,456,627 | 10/1995 | Jackson et al. . | |
| 5,461,007 | 10/1995 | Kobayashi . | |
| 5,664,987 | 9/1997 | Renteln | 451/5 |
| 5,702,292 | 12/1997 | Brunelli et al. | 451/287 |
| 5,782,675 | 7/1998 | Southwick | 451/287 |
| 5,801,066 | 9/1998 | Meikle | 451/287 |
| 5,839,947 | 11/1998 | Kimura et al. | 451/287 |
| 5,857,898 | 1/1999 | Hiyama et al. | 451/287 |
| 5,860,847 | 1/1999 | Sakurai et al. | 451/287 |

*Primary Examiner*—David A. Scherbel
*Assistant Examiner*—Derris H. Banks
*Attorney, Agent, or Firm*—Seed and Berry, LLP

[57] ABSTRACT

A method and apparatus for selectively conditioning a planarizing surface of a polishing pad. In one embodiment, a conditioning system has a carrier assembly with an arm that may be positioned over a polishing pad, a conditioning element coupled to the arm, and an actuator coupled to the arm to move the conditioning element into engagement with the planarizing surface of the polishing pad. The conditioning element is an abrasive member, such as an abrasive disk or a brush. The conditioning system may also have a controller operatively coupled to the engagement actuator to control an operating parameter of the conditioning element as a function of the distribution of a surface characteristic across the planarizing surface of the polishing pad.

77 Claims, 4 Drawing Sheets

METHOD AND APPARATUS FOR SELECTIVELY CONDITIONING A POLISHED PAD USED IN PLANARIZNG SUBSTRATES

TECHNICAL FIELD

The present invention relates to conditioning polishing pads used in planarizing substrates. More specifically, an embodiment of the invention relates to a method and apparatus for selectively varying the extent of conditioning across a planarizing surface of a polishing pad in correspondence to a surface characteristic of the planarizing surface.

BACKGROUND OF THE INVENTION

Chemical-mechanical polishing ("CMP") processes remove material from the surface of semiconductor wafers or other substrates in the production of microelectronic devices and other products. CMP processes typically planarize and/or polish the surface of a substrate in the fabrication of integrated circuits by moving the substrate across a polishing medium.

FIG. 1 is a schematic view that illustrates a conventional CMP machine 10 with a platen 20, a wafer carrier 30, a polishing pad 40, and a planarizing liquid 44 on the polishing pad 40. The platen 20 is typically connected to a drive assembly 26 to rotate the platen 20 (indicated by arrow A) or reciprocate the platen 20 back and forth (indicated by arrow B). Additionally, the wafer carrier 30 generally has a lower surface 32 to which a wafer 12 may be attached, or the wafer 12 may be attached to a resilient pad 34 positioned between the wafer 12 and the lower surface 32. The wafer carrier 30 is generally attached to an actuator assembly 36 to impart axial and/or rotational motion to the wafer 12 (indicated by arrows C and D, respectively), or the wafer carrier 30 may be a weighted, free-floating wafer holder (not shown).

The polishing pad 40 and the planarizing liquid 44 may separately, or in combination, define a polishing medium that mechanically and/or chemically removes material from the surface of a wafer. The polishing pad 40 may be a conventional polishing pad made from a continuous phase matrix material (e.g., polyurethane), or it may be a new generation abrasive polishing pad made from abrasive particles fixedly dispersed in a suspension medium. Conversely, the planarizing liquid 44 may be a conventional CMP slurry with abrasive particles, or it may be a planarizing solution without abrasive particles. In general, abrasive slurries are used with conventional non-abrasive polishing pads and planarizing solutions are used with abrasive polishing pads.

To planarize the wafer 12 with the CMP machine 10, the wafer carrier 30 presses the wafer 12 face-downward against the polishing medium. More specifically, the wafer carrier 30 generally presses the wafer 12 against the planarizing liquid 44 on a planarizing surface 42 of the polishing pad 40, and at least one of the platen 20 or the wafer carrier 30 moves relative to the other to move the wafer 12 across the planarizing surface 42. As the wafer 12 moves across the planarizing surface 42, material is removed from the face of the wafer 12.

In the competitive semiconductor industry, it is desirable to maximize the throughput of finished wafers and to produce a uniform, planar surface on each wafer. The throughput of CMP processing is a function of several factors, one of which is the rate at which the thickness of the wafer decreases as it is being planarized (the "polishing rate"). The polishing rate affects the throughput because the polishing period per wafer decreases with increasing polishing rates and it is easier to accurately endpoint CMP processing with a consistent polishing rate. Thus, it is desirable to have a high, consistent polishing rate.

One manufacturing concern with CMP processing is that the throughput may drop because planarizing wafers alters the condition of the polishing pads. More specifically, particles from the wafer, pad and/or slurry accumulate on the planarizing surface of the polishing pad and form waste matter accumulations that may cover portions of the planarizing surface. The polishing rate accordingly changes during CMP processing, which may make it more difficult to quickly planarize a wafer or endpoint the CMP process. Thus, the waste matter accumulations may reduce the throughput of CMP processing.

CMP processes must also consistently and accurately produce a uniform, planar surface on the wafer because it is important to accurately focus the image of circuit patterns on the surface of the wafer. As the density of integrated circuits increases, it is often necessary to accurately focus the critical dimensions of the circuit pattern to within a tolerance of approximately 0.1 $\mu$m. Focusing circuit patterns to such small tolerances, however, is very difficult when the surface of the wafer is not uniformly planar. Thus, planarizing processes must create a highly uniform, planar surface.

Another problem with CMP processing is that the waste matter accumulations reduce the uniformity of the polishing rate across the planarizing surface of a polishing pad. The waste matter accumulations do not accumulate uniformly across the planarizing surface of the polishing pad, and thus the polishing rate may vary unpredictably across the polishing pad. As a result, the surface of a polished wafer may not be uniformly planar.

In light of the problems associated with waste matter accumulations on polishing pads, it is necessary to periodically remove the waste matter accumulations from the planarizing surfaces so that the polishing pads are brought back into a desired state for planarizing substrates ("conditioning"). For example, U.S. Pat. No. 5,456,627 issued to Jackson et al. discloses an apparatus for conditioning a rotating, circular polishing pad with a rotating end effector that has an abrasion disk in contact with a polishing surface of the pad. The end effector described in U.S. Pat. No. 5,456,627 moves along a radius of the polishing pad surface at a variable velocity to compensate for the linear velocity of the polishing pad surface. Additionally, U.S. Pat. No. 5,456,627 discloses maintaining a desired contact force between the end effector and the polishing pad surface with a closed feedback loop in which a load transducer generates a signal with an amplitude proportional to the applied force. A computer then uses the signal from the load transducer to operate an actuator that moves the end effector in a direction so that the output of the load transducer is substantially equal to the desired contact force.

Another conventional conditioning method and apparatus, which is disclosed in U.S. Pat. No. 5,081,051 issued to Mattingly et al., is an elongated blade with a serrated edge that is engaged with a portion of a circular, rotating polishing pad. The blade disclosed in U.S. Pat. No. 5,081,051 is pressed against a polishing path on the planarizing surface of the polishing pad to scrape or cut grooves into the planarizing surface.

Conventional conditioning methods and devices, however, may reduce the pad life of polishing pads because they may over-condition some areas on the planarizing surface. Additionally, conventional conditioning methods and devices may result in a non-planar surface on the polishing pads. Therefore, it would be desirable to develop a method and apparatus that improves the conditioning of polishing pads.

SUMMARY OF THE INVENTION

The present invention is a method and apparatus for selectively conditioning a planarizing surface of a polishing pad. In one embodiment, a conditioning system has a carrier assembly, a conditioning element attached to the carrier assembly, and a controller operatively coupled to the carrier assembly to control an operating parameter of the conditioning element. The carrier assembly may have an arm to which the conditioning element is attached, and an actuator maybe coupled to the arm to move the conditioning element with respect to the planarizing surface of the polishing pad. In operation, the controller adjusts an operating parameter of the conditioning element as a function of a distribution of a surface characteristic across the planarizing surface. Thus, an embodiment of the invention can selectively vary the extent of conditioning across the planarizing surface to improve the planarity of the polishing pad and reduce over conditioning according to the distribution of the selected surface characteristic.

In one embodiment of the invention, an operating parameter of the conditioning element is selectively adjusted to have a first removal rate of material from the polishing pad at a first location and a second removal rate of material from the polishing pad at a second location. The first removal rate is selected according to a first quantity of a surface characteristic at the first location, and the second removal rate is selected according to a second quantity of a surface characteristic at a second location. For example, if the contour of the planarizing surface is higher at the first location than at the second location, the first removal rate of material may be greater than the second removal rate to remove more material from the first location and enhance the planarity of the polishing pad. Similarly, when the thickness of waste matter accumulations is greater at the first location than at the second location, the first removal rate of material is generally greater than the second removal rate. Therefore, an embodiment of the invention may selectively vary the amount of material removed from one area on the polishing pad to another as a function of the extent of conditioning that is required at the different areas.

In another embodiment of the conditioning system, the controller varies the down-force applied to the conditioning element in correspondence to the distribution of waste matter across the planarizing surface of the polishing pad. The controller may accordingly have a database programmed with an estimate of the locations and the thicknesses of waste matter accumulations across the planarizing surface based upon real-time input of the residence time of the substrate across the planarizing surface or historical glazing characteristics of a particular CMP process. Additionally, the controller may be operatively coupled to the actuator to adjust the height of the arm carrying the conditioning element, thus varying the down-force applied to the conditioning element. In general, the controller increases the down-force applied to the conditioning element with increasing thicknesses of waste matter accumulations across the polishing pad according to the estimated distribution of waste matter accumulations.

DETAILED DESCRIPTION OF THE INVENTION

Figure 2:
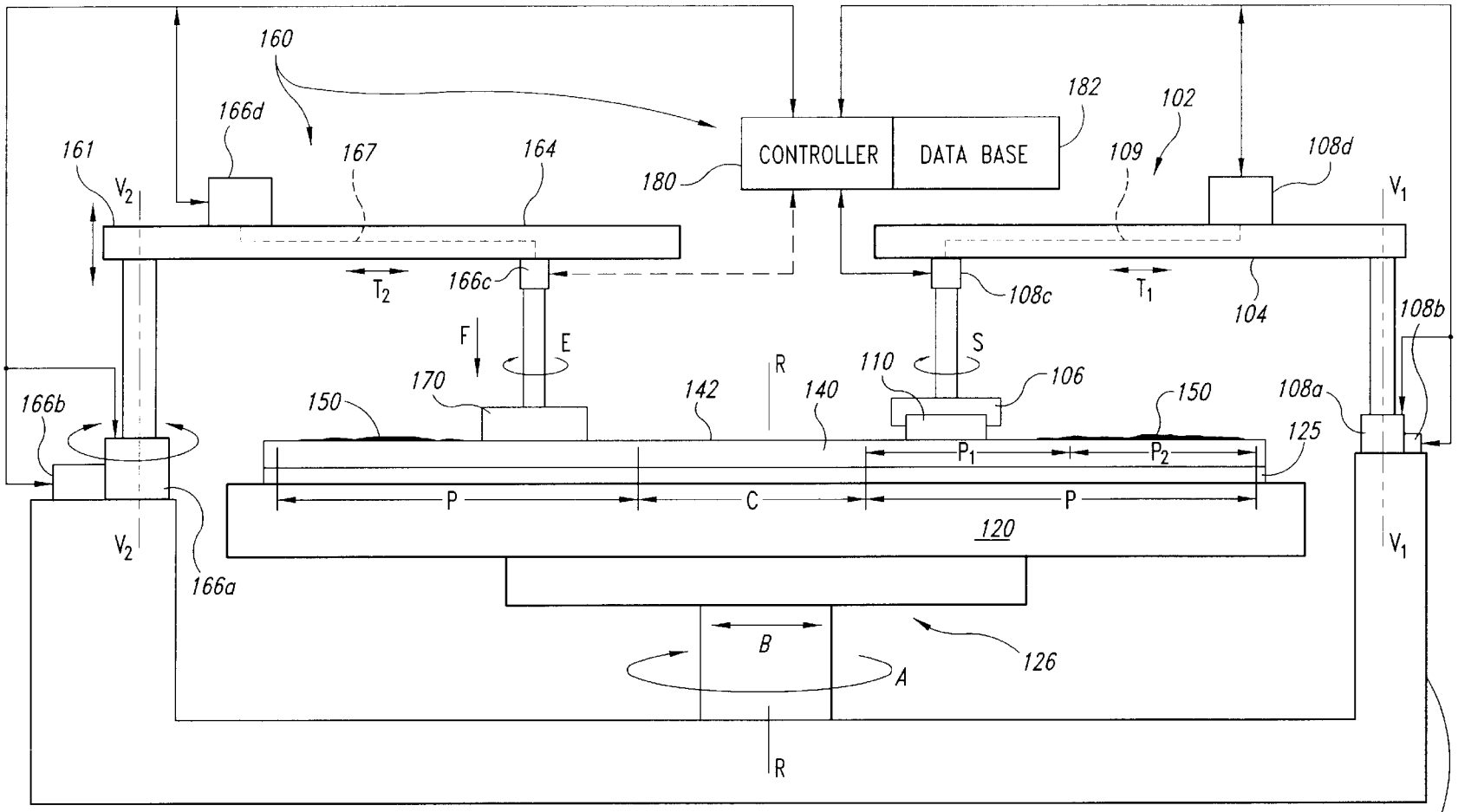
FIG. 2 is a schematic view of an embodiment of a planarizing machine with a conditioning system in accordance with the invention.
Figure 3:
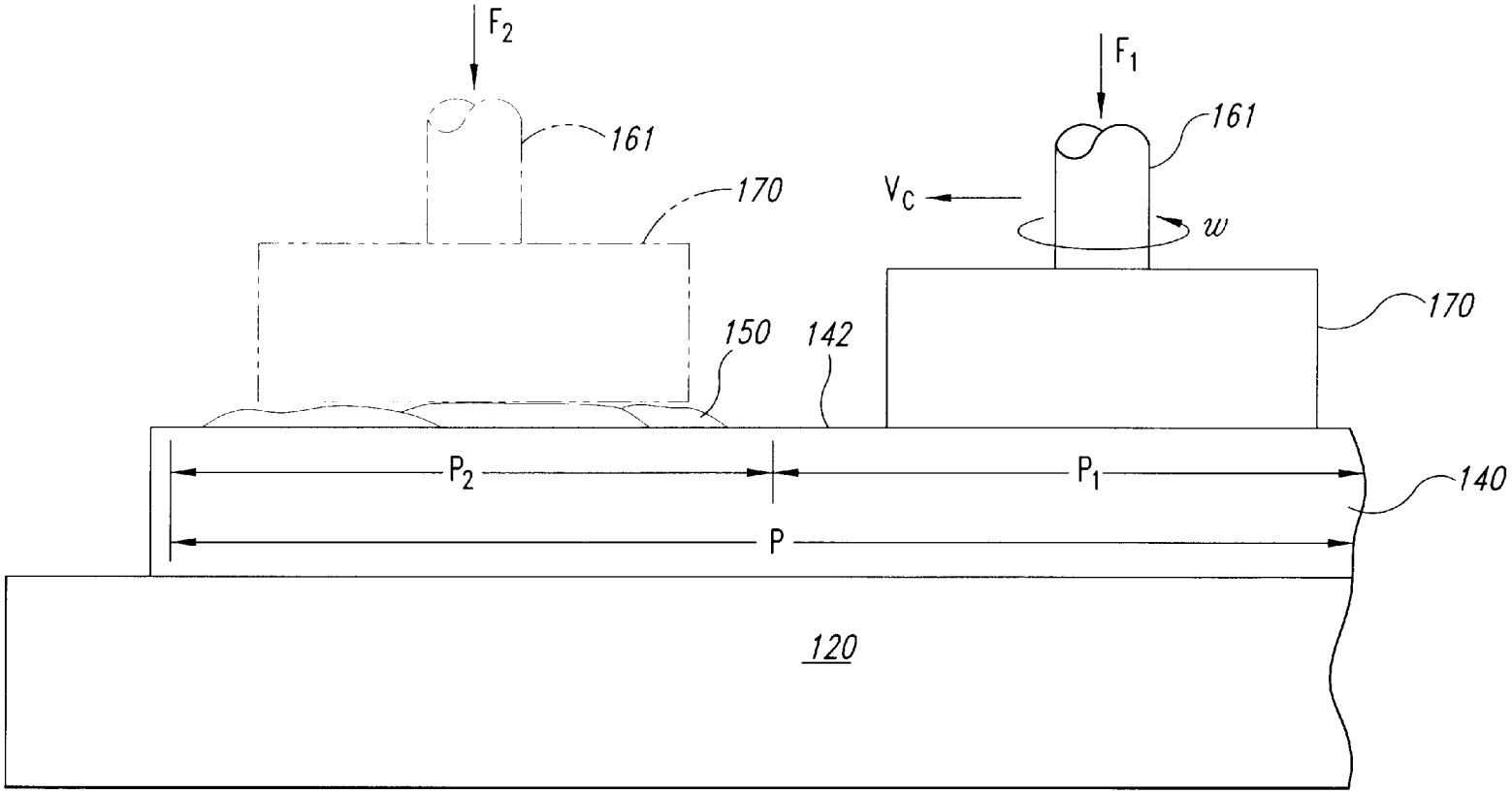
FIG. 3 is a partial schematic side view of a conditioning element of an embodiment of a conditioning system in accordance with the invention over a polishing pad glazed with waste matter accumulations.
Figure 4:
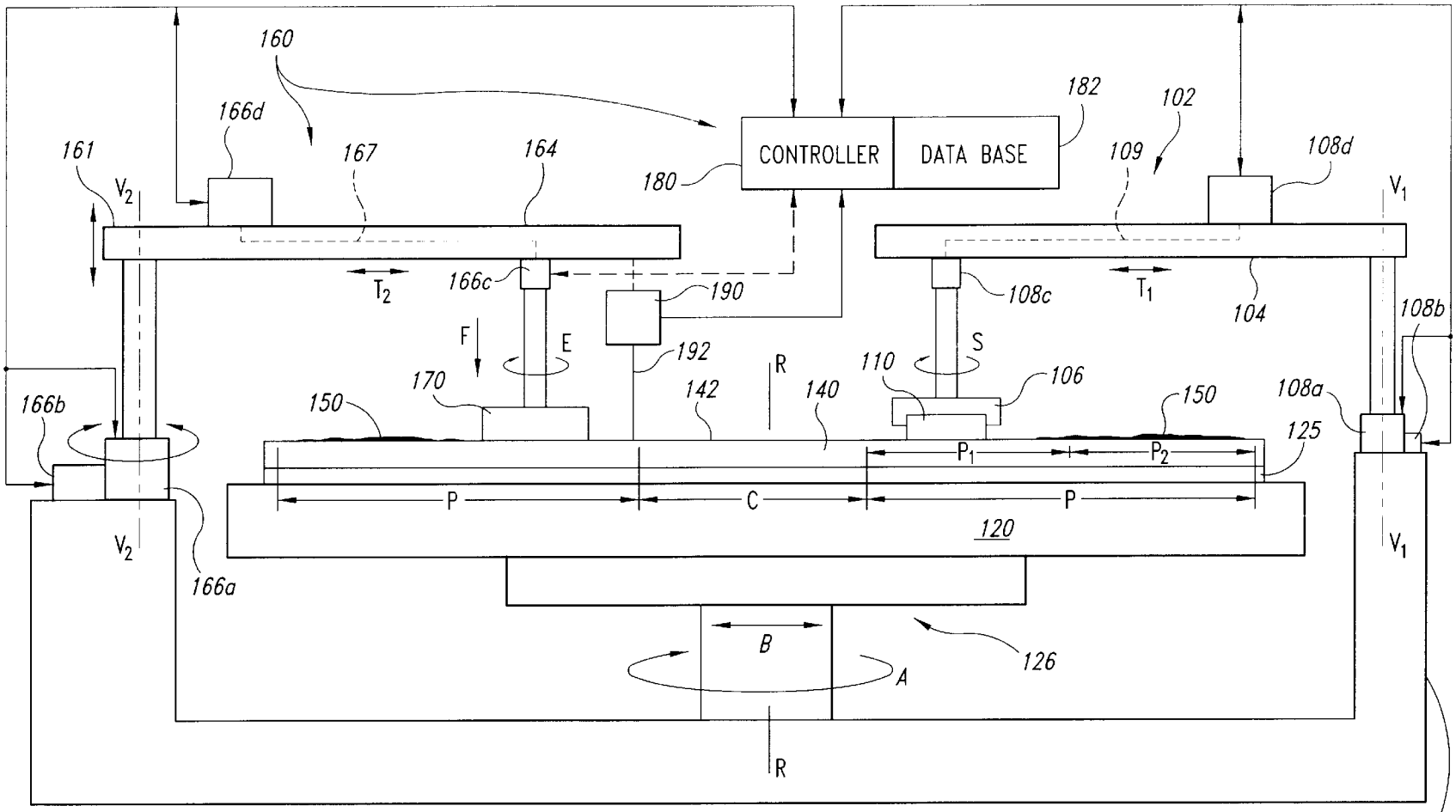
FIG. 4 is a schematic view of another embodiment of a planarizing machine with a conditioning system in accordance with the invention.

The present invention is a method and apparatus for selectively conditioning polishing pads used to planarize substrates, such as semiconductor wafers, field emission displays and other related substrates. An aspect of an embodiment of the invention is to evaluate a planarizing surface of a polishing pad to estimate the locations and thicknesses of waste matter accumulations across the planarizing surface. Another aspect of an embodiment of the invention is to move an abrasive conditioning element across the planarizing surface at a constant velocity while varying the down-force applied to the conditioning element as a function of the estimated thicknesses of the waste matter accumulations. Accordingly, an embodiment of the invention selectively varies the amount of material removed from one area to another across the planarizing surface of the polishing pad according to the extent of conditioning required at the different areas. FIGS. 2–4 illustrate various embodiments of conditioning methods and apparatus, and like reference numbers refer to like parts throughout the various figures.

Figure 1:
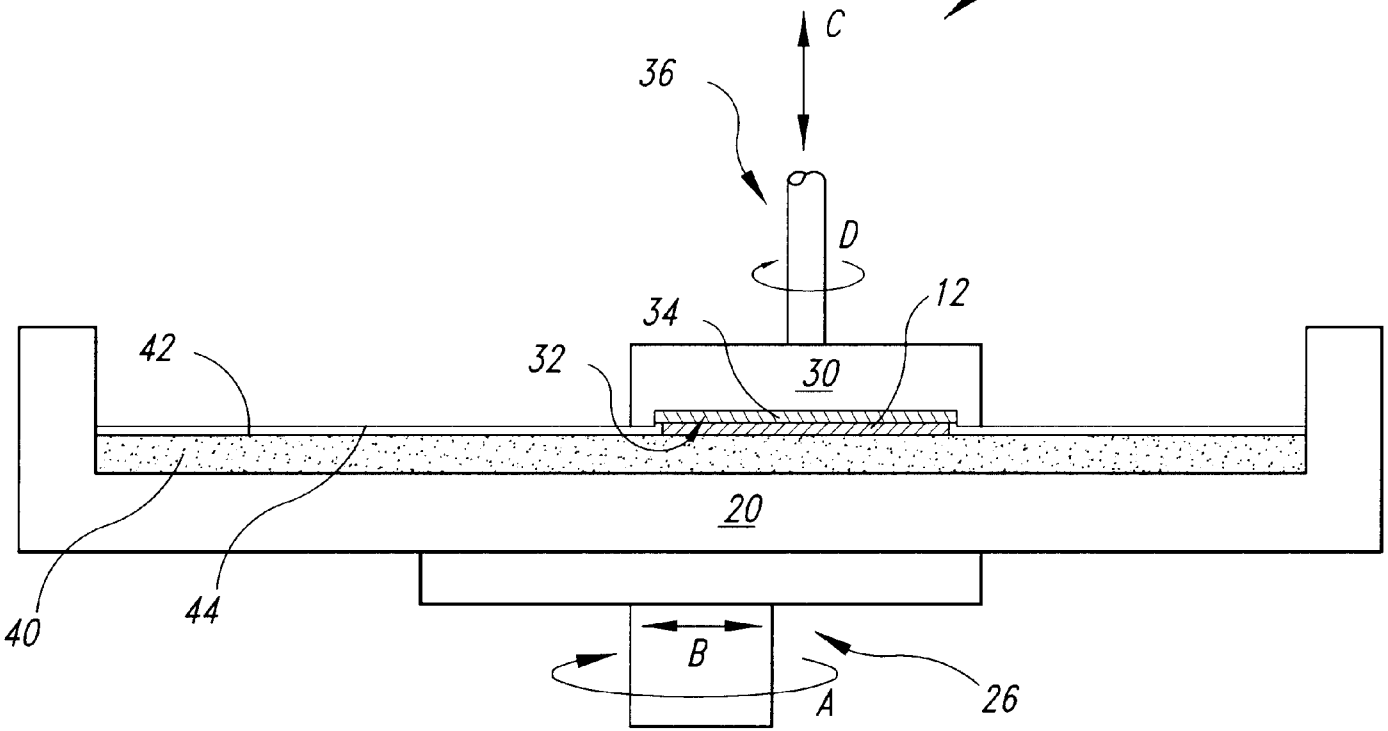
Fig. 1 (Prior Art)
FIG. 1 is a schematic view of a planarizing machine in accordance with the prior art.

FIG. 2 is a schematic view of a CMP machine 100 with a substrate carrier assembly 102 and a conditioning system 160 attached to separate areas of a housing 101. As discussed above with respect to FIG. 1, the CMP machine 100 also has a platen 120, an under pad 125 mounted to the platen 120, and a polishing pad 140 mounted to the top surface of the under pad 125. The embodiment of the substrate carrier assembly 102 shown in FIG. 2 has a primary actuator 108*a* attached to the housing 101, an arm 104 attached to the primary actuator 108*a* to project over the polishing pad 140, and a chuck 106 attached to the arm 104 by a chuck actuator 108*c*. The primary actuator 108*a* moves the arm 104 vertically along an axis $V_1$—$V_1$, and a motor 108*b* connected to the primary actuator 108*a* rotates the arm 104 about the axis $V_1$—$V_1$. Additionally, a translational actuator 108*d* may be operatively coupled to the chuck 106 by a connector 109 to translate the chuck 106 along a longitudinal axis of the arm 104 (shown by arrow $T_1$).

To planarize the wafer 110, the platen 120 and polishing pad 140 rotate (indicated by arrow A) while the primary actuator 108*a* lowers the arm 104 until the substrate 110 engages a planarizing surface 142 of the polishing pad 140. The chuck actuator 108*c* then rotates the chuck 106 (indicated by arrow S) as the translational actuator 108*d* moves the substrate 110 back and forth across the planarizing surface 142 within a planarizing zone P. The planarizing zone P is typically a well-defined region on the planarizing surface 142 concentric to the center of the polishing pad such that the substrate 10 does not engage a center region C of the planarizing surface 142.

During planarization of the substrate 110, particles and other matter aggregate on the planarizing surface 142 and form waste matter accumulations 150 in the planarizing zone P. It is generally believed that the distribution (location and thickness) of the waste matter accumulations 150 is a function, in part, of: (1) the relative velocity between the substrate 110 and the polishing pad 140; and (2) the radial residence time of the substrate 110 across the planarizing zone P. Thus, waste matter accumulations are generally relatively thin or nonexistent at an inner portion of an interior region PI of the planarizing zone P. Conversely, waste matter accumulations are generally relatively thick and cover a greater percentage of the planarizing surface 142 at a central portion of a perimeter region $P_2$ of the planarizing zone P.

The waste matter accumulations 150 are particularly problematic when thick glazing of the substrate occurs on the planarizing surface 142. The waste matter accumulations 150 illustrated in FIG. 2 are exaggerations of the type of glazing that can occur when planarizing a soft layer of material from the substrate 110, such as a layer of doped polysilicon. For example, after polishing a doped polysilicon layer for only four minutes with an IC-1000 polishing pad and an ILD-1300 slurry (both of which are manufactured by Rodel Corporation of Newark, Del.), the waste matter accumulations on the planarizing surface 142 alter the polishing rate of the polishing pad. Therefore, glazed waste matter accumulations 150 are a significant problem in CMP processing.

To remove waste matter accumulations 150 from the polishing pad 140, the conditioning system 160 may be attached to the CMP machine 100 to operate in-situ and in real-time during the planarization of the substrate 110. The embodiment of the conditioning system 160 shown in FIG. 2 has a carrier assembly 161, a conditioning element 170 attached to the carrier assembly 161, and a controller 180 for controlling an operating parameter of the conditioning element 170. As described above with respect to the substrate carrier 102, the carrier assembly 161 may have an arm 164 attached to a primary actuator 166*a* that moves the arm 164 vertically along an axis $V_2$—$V_2$, and the primary actuator 166*a* may be connected to a motor 166*b* to rotate the arm 164 about the axis $V_2$—$V_2$. The conditioning element 170 may be attached to a secondary actuator 166*c* that rotates the conditioning element 170 (indicated by arrow E), and a translational actuator 136*d* may be operatively coupled to the secondary actuator 166*c* by a connector 167 to translate the conditioning element 170 along the arm 164 (shown by arrow $T_2$). The conditioning element 170 is generally an abrasive disk, brush or other known device that abrades or otherwise cleans waste matter from the planarizing surface 142 of the polishing pad 140. As described below, the conditioning element 170 is controlled to selectively adjust the amount of material that the conditioning element 170 removes from different areas on the planarizing surface 142.

In one embodiment of the invention, the controller 180 controls an operating parameter of the conditioning element 170 via at least one of the actuators 166*a*–166*d* in correspondence to a surface characteristic across the planarizing surface 142 of the polishing pad 140. For example, the controller 180 may control the conditioning element 170 according to a distribution of waste matter accumulations 150 across the planarizing surface 142. It will be appreciated, however, that the controller 180 may control the conditioning element 170 in correspondence to one or more other surface characteristics. Accordingly, the controller may control an operating parameter of the conditioning element according to the topography of the planarizing surface 142, the distribution of abrasive particles across the planarizing surface 142, and/or the distribution of filler material in the polishing pad that is exposed at the planarizing surface 142.

In addition to controlling the conditioning element 170 based upon several different surface characteristics across the planarizing surface 142 of the polishing pad 140, the controller 180 may control several different operating parameters of the conditioning element 170. In general, the controller 180 may be coupled to one or more of the actuators 166*a*–166*d* to vary the amount of material that the conditioning element 170 removes from different areas on the polishing pad 140 in correspondence to the selected surface characteristics of the polishing pad 140. For example, the controller 180 may be operatively coupled to the primary actuator 166*a* to adjust the down-force F applied to the conditioning element 170 through the primary actuator 166*a* and the arm 164. The controller 180 may alternatively be coupled to the motor 166*b* to adjust the rotational velocity of the conditioning element 170, or the controller 180 may be coupled to the translational actuator 166*d* to adjust the rate at which the conditioning element 170 translates across the polishing pad 140. Accordingly, the controller 180 may be coupled to the actuators 166*a*–166*d* to selectively control several different operating parameters of the conditioning element 170 so that different amounts of material can be removed from different areas on the polishing pad 140.

The specific surface characteristics that the controller 180 uses to control the conditioning element 170 are either stored in a database 182 coupled to the controller 180 or processed in real-time by the controller 180. For example, when the surface characteristic is the distribution of waste matter accumulations 150 across the planarizing surface 142, the controller 180 may estimate the distribution of the waste matter accumulations 150 in real-time based upon the residence time that the substrate 110 engages the surface of the planarizing zone P. In this embodiment, for example, the controller 180 correlates position data from the primary actuator 108*a*, the rotational motor 108*b* and the translational actuator 108*d* of the substrate carrier assembly 102. Such position measurements are obtained by monitoring the rotational velocities of the pad 140 and the substrate 110, and monitoring the translational velocity of the substrate 10, which are within the skill of an ordinary person in the art. It will be appreciated that the actual distribution of the waste matter accumulations 150 in the planarizing zone P will generally be different than the estimated distribution based upon the residence time of the substrate 110 because the relative velocity between the substrate 110 and the planarizing surface 142 increases toward the perimeter of the polishing pad 140. A correlation factor may accordingly be determined empirically and programmed into the database 182 of the controller 180 to more closely correlate the substrate residence time with the actual distribution of waste matter accumulations 150. Alternately, an estimate of the distribution of waste matter accumulations 150 may be determined empirically stored in the database 182. It will be appreciated that other methods may also be used to determine the distribution of waste matter accumulations 150 across the planarizing surface 142. Additionally, the methods for determining the distribution of waste matter accumulations are within the skill of an ordinary person in the art.

FIG. 3 is a partial schematic side view of the conditioning element 170 and the polishing pad 140 that further illustrates an embodiment of one method for conditioning a polishing pad 140 in accordance with the invention. In this embodiment, the carrier assembly 161 translates the conditioning element 170 across the planarizing surface 142 of the polishing pad 140 at a constant velocity $V_c$ and rotates the conditioning element 170 at a constant angular velocity w. When the conditioning element 170 engages the interior planarizing region $P_1$ where the waste matter accumulations 150 are thin or do not exist, the controller 180 (FIG. 2) prompts the primary actuator 166*a* (FIG. 2) to apply a first down-force $F_1$ to the conditioning element 170. As the conditioning element 170 translates into the perimeter region $P_2$ of the planarizing zone P (shown in broken lines), the controller 180 processes the estimated distribution of the waste matter accumulations 150 and activates the primary actuator 166*a* to increase the down-force applied to the conditioning element 170 to a second down-force $F_2$. In the embodiment of the method shown in FIG. 3, the controller 180 activates the primary actuator 166*a* to increase the down-force applied to the conditioning element 170 corresponding to an estimated increase in thickness of waste matter accumulations 150. The conditioning element 170 accordingly removes increasing amounts of material from areas on the planarizing surface 142 with increasing thicknesses of waste matter accumulations 150 without removing unnecessary amounts of material from other areas on the planarizing surface 142.

One advantage of the conditioning system 160 is that it prolongs the pad-life of polishing pads because it selectively removes material from the planarizing surface according to the location and thickness of the waste matter accumulations on the polishing pad. Unlike conventional conditioning methods and devices that remove a uniform thickness of material on the planarizing surface of a polishing pad, an embodiment of the conditioning device 160 varies the amount of material removed from different areas on the planarizing surface according to the distribution of waste matter accumulations. Accordingly, an embodiment of the conditioning system 160 is more likely to remove thick waste matter accumulations 150 from the planarizing surface without over-conditioning other areas on the planarizing surface that were covered with only thin waste matter accumulations. An embodiment of the conditioning system 160, therefore, generally prolongs the pad-life of polishing pads compared to conventional conditioning systems.

Another advantage of the conditioning system 160 is that it should provide better control of the polishing rate during CMP processing. It will be appreciated that non-planar polishing pads generally produce erratic polishing rates because high points on a polishing pad will remove material from a substrate faster than low points. Since the conditioning system 160 selectively removes more material from high points on the planarizing surface than low points, the conditioning system 160 enhances the planarity of the planarizing surface. Accordingly, an embodiment of the conditioning system 160 may result in more uniform polishing rates across the polishing pad.

FIG. 4 is a schematic view of another embodiment of a planarizing machine 200. Unlike the planarizing machine 100 in which the controller 180 may be operatively coupled to the substrate carrier assembly 102 to estimate the distribution of waste matter accumulations 150, the planarizing machine 200 shown in FIG. 4 has a sensor 190 operatively coupled to the controller 180 to measure the distribution of waste matter accumulations 150. The sensor 190 may be attached to the arm 164 of the carrier assembly 161 so that it translates along the arm 164 with the conditioning element 170. The sensor 190 generally has an element 192 that engages the planarizing surface 142 and the waste matter accumulations 150 to determine the locations and/or the thicknesses of the waste matter accumulations 150 across the planarizing surface 142. In one embodiment, the sensor 190 is an interferometer in which the element 192 is a laser beam that measures a change in contour of the planarizing surface 142 and the waste matter accumulations 150. Suitable interferometer systems for measuring the contour of the polishing pad are well known in the art. In another embodiment, the sensor 190 is a piezoelectric sensor and the element 192 is a stylus that engages the planarizing surface 142 and the waste matter accumulations 150. A suitable piezoelectric sensor system for measuring the contour of the polishing pad 140 is disclosed in U.S. Pat. No. 5,618,447, entitled POLISHING PAD CONTOUR METER AND METHOD FOR REAL-TIME CONTROL OF THE POLISHING RATE IN CHEMICAL MECHANICAL POLISHING OF SEMICONDUCTOR WAFERS, which is herein incorporated by reference. In either embodiment, the sensors 190 indicate the contour of the planarizing surface 142 and the waste matter accumulations 150 to estimate the distribution of the waste matter accumulations 150 with respect to a reference level for the planarizing surface 142. As discussed above, the controller 180 processes the data from the sensor 190 to control one or more operating parameters of the conditioning element 170 so that different amounts of material may be selectively removed from different areas on the planarizing surface.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method of conditioning a planarizing surface of a polishing pad for planarizing a substrate, comprising:

determining a representation of a distribution of a surface characteristic on the planarizing surface of the polishing pad; and selectively removing a non-uniform thickness of material from the planarizing surface of the polishing pad according to the determined distribution of the surface characteristic of the polishing pad.

2. The method of claim 1 wherein the act of removing comprises controlling an operating parameter of a conditioning element to selectively remove different thicknesses of material from different areas on the planarizing surface of the polishing pad according to the determined distribution of the surface characteristic.

3. The method of claim 2 wherein the act of controlling comprises:

pressing the conditioning element against the planarizing surface of the polishing pad at a down-force;

moving the conditioning element across the planarizing surface of the polishing pad; and adjusting the down-force applied to the conditioning element as a function of the distribution of the surface characteristic.

4. The method of claim 3 wherein the surface characteristic is the thickness of waste matter accumulations and the act of adjusting comprises increasing the down-force with increasing thicknesses of waste matter accumulations.

5. The method of claim 3 wherein the surface characteristic is the contour of the planarizing surface and the act of adjusting comprises increasing the down-force with increasing elevation of the planarizing surface.

6. The method of claim 3 wherein the conditioning element is coupled to an actuator that raises and lowers the conditioning element with respect to the planarizing surface, and wherein the act of adjusting comprises activating the actuator to lower the conditioning element and increase the down-force with increasing thicknesses of the surface characteristic and to raise the conditioning element and decrease the down-force with decreasing thicknesses of the surface characteristic.

7. The method of claim 2 wherein the act of controlling comprises:

pressing the conditioning element against the planarizing surface of the polishing pad at a down-force;

translating the conditioning element across the planarizing surface of the polishing pad; and rotating the conditioning element at an angular velocity as a function of the distribution of the surface characteristic.

8. The method of claim 7 wherein the surface characteristic is the thickness of waste matter accumulations and the act of rotating comprises increasing the rotational velocity with increasing thicknesses of waste matter accumulations.

9. The method of claim 7 wherein the surface characteristic is the contour of the planarizing surface and the act of rotating comprises increasing the rotational velocity with increasing elevation of the planarizing surface.

10. The method of claim 7 wherein the conditioning element is coupled to an actuator that rotates the conditioning element with respect to the planarizing surface, and wherein the act of rotating comprises activating the actuator to increase the rotational velocity with increasing thicknesses of the surface characteristic and to decrease the rotational velocity with decreasing thicknesses of the surface characteristic.

11. The method of claim 2 wherein the act of controlling comprises:

pressing the conditioning element against the planarizing surface of the polishing pad at a down-force;

translating the conditioning element across the planarizing surface of the polishing pad at different velocities as a function of the distribution of the surface characteristic; and rotating the conditioning element at an angular velocity.

12. The method of claim 11 wherein the surface characteristic is the thickness of waste matter accumulations and the act of translating comprises decreasing the velocity with increasing thicknesses of waste matter accumulations.

13. The method of claim 11 wherein the surface characteristic is the contour of the planarizing surface and the act of translating comprises decreasing the velocity with increasing elevation of the planarizing surface.

14. The method of claim 11 wherein the conditioning element is coupled to an actuator that translates the conditioning element with respect to the planarizing surface, and wherein the act of translating comprises activating the actuator to decrease the velocity with increasing thicknesses of the surface characteristic and to increase the velocity with decreasing thicknesses of the surface characteristic.

15. The method of claim 2 wherein the surface characteristic is the thickness of waste matter accumulations on the planarizing surface of the polishing pad, and the act of determining the representation of the distribution of the surface characteristic comprises measuring a residence time of a substrate across the planarizing surface during planarization.

16. The method of claim 15 wherein the conditioning element is coupled to a controller and the controller is coupled to a substrate carrier assembly, and wherein the act of measuring the substrate residence time comprises processing position signals generated by the substrate carrier assembly to determine the residence time that the substrate contacts areas across the planarizing surface.

17. The method of claim 2 wherein the surface characteristic is the thickness of waste matter accumulations on the planarizing surface of the polishing pad, and the act of determining the representation of the distribution of the surface characteristic comprises measuring a contour of the planarizing surface relative to a reference height for an exposed area on the planarizing surface without waste matter.

18. The method of claim 17 wherein the act of measuring the contour of the planarizing surface comprises sensing a change in height of the planarizing surface with an interferometer.

19. The method of claim 17 wherein the act of measuring the contour of the planarizing surface comprises sensing a change in height of the planarizing surface with a piezoelectric sensor and a stylus that engages the planarizing surface.

20. A method of conditioning a planarizing surface of a polishing pad for planarization of a substrate, comprising:

determining a representation of a distribution of a surface characteristic on the planarizing surface of the polishing pad; and controlling an operating parameter of a conditioning element to selectively remove different thicknesses of material from the planarizing surface in correspondence to the distribution of the surface characteristic.

21. The method of claim 20 wherein the act of controlling comprises:

pressing the conditioning element against the planarizing surface of the polishing pad at a down-force;

moving the conditioning element across the planarizing surface of the polishing pad; and adjusting the down-force applied to the conditioning element as a function of the distribution of the surface characteristic.

22. The method of claim 21 wherein the surface characteristic is the thickness of waste matter accumulations and the act of adjusting comprises increasing the down-force with increasing thicknesses of waste matter accumulations.

23. The method of claim 21 wherein the surface characteristic is the contour of the planarizing surface and the act of adjusting comprises increasing the down-force with increasing elevation of the planarizing surface.

24. The method of claim 20 wherein the surface characteristic is the thickness of waste matter accumulations on the planarizing surface of the polishing pad, and the act of determining the representation of the distribution of the surface characteristic comprises measuring a residence time of a substrate across the planarizing surface during planarization.

25. The method of claim 20 wherein the surface characteristic is the thickness of waste matter accumulations on the planarizing surface of the polishing pad, and the act of determining the representation of the distribution of the surface characteristic comprises measuring a contour of the planarizing surface relative to a reference height for an exposed area on the planarizing surface without waste matter.

26. The method of claim 20 wherein the act of controlling comprises adjusting a residence time of the conditioning element on areas of the planarizing surface as a function of the determined distribution of the surface characteristic.

27. The method of claim 26 wherein the act of adjusting the residence time of the conditioning element comprises translating the conditioning element across the planarizing surface at different velocities as a function of the determined distribution of the surface characteristic.

28. A method of conditioning a planarizing surface of a polishing pad with a conditioning element, comprising selectively adjusting an operating parameter of the conditioning element to have a first removal rate of material from the polishing pad at a first location with a first quantity of waste matter and a second removal rate of material from the polishing pad at a second location with a second quantity of waste matter, the first removal rate being greater than the second removal rate and the first amount of waste matter being greater than the second amount of waste matter.

29. The method of claim 28 wherein the act of adjusting an operating parameter of the conditioning element comprises:

determining a representation of a distribution of the waste matter on the planarizing surface of the polishing pad; and controlling the operating parameter of the conditioning element to selectively remove increasing amounts of material from the polishing pad with increasing thicknesses of waste matter.

30. The method of claim 29 wherein the act of controlling comprises:

pressing the conditioning element against the planarizing surface of the polishing pad at a down-force;

moving the conditioning element across the planarizing surface of the polishing pad; and changing the down-force applied to the conditioning element as a function of the distribution of the waste matter.

31. The method of claim 30 wherein act of changing the down-force comprises increasing the down-force with increasing thicknesses of waste matter.

32. The method of claim 29 wherein the act of determining a representation of the distribution of the waste matter accumulations comprises measuring a residence time of a substrate across the planarizing surface during planarization.

33. The method of claim 29 wherein the act of determining a representation of the distribution of the waste matter accumulations comprises measuring a contour of the planarizing surface relative to a reference height for an exposed area on the planarizing surface without waste matter.

34. A method of conditioning a planarizing surface of a polishing pad with a conditioning element, comprising:

evaluating the planarizing surface to determine a thickness profile of waste matter accumulations across the planarizing surface;

controlling an operating parameter of a conditioning element to increase a removal rate of material from the planarizing surface with increasing thicknesses of waste matter.

35. The method of claim 34 wherein the act of controlling comprises:

pressing the conditioning element against the planarizing surface of the polishing pad at a down-force;

moving the conditioning element across the planarizing surface of the polishing pad; and adjusting the down-force applied to the conditioning element as a function of the thickness profile of waste matter accumulations.

36. The method of claim 35 wherein act of adjusting the down-force comprises increasing the down-force with increasing thicknesses of waste matter accumulations.

37. The method of claim 34 wherein the act of evaluating comprises measuring a residence time of a substrate across the planarizing surface during planarization.

38. The method of claim 34 wherein the act of evaluating comprises measuring a contour of the planarizing surface relative to a reference height for an exposed area on the planarizing surface without waste matter.

39. A method of conditioning a planarizing surface of a polishing pad with a conditioning element, comprising:

estimating a distribution of waste matter across the planarizing surface of the polishing pad;

controlling an operating parameter of the conditioning element to have a first removal rate of material from the polishing pad at a first location with a first amount of waste matter and a second removal rate of material from the polishing pad at a second location with a second amount of waste matter, the first removal rate being greater than the second removal rate and the first amount of waste matter being greater than the second amount of waste matter.

40. The method of claim 39 wherein the act of controlling comprises:

pressing the conditioning element against the planarizing surface of the polishing pad at a down-force;

moving the conditioning element across the planarizing surface of the polishing pad; and changing the down-force applied to the conditioning element as a function of the estimated distribution of the waste matter.

41. The method of claim 40 wherein act of changing the down-force comprises increasing the down-force with increasing thicknesses of waste matter.

42. The method of claim 39 wherein the act of estimating the distribution of waste matter comprises measuring a residence time of a substrate across the planarizing surface during planarization.

43. The method of claim 39 wherein the act of estimating the distribution of waste matter comprises measuring a contour of the planarizing surface relative to a reference height for an exposed area on the planarizing surface without waste matter.

44. A method of conditioning a planarizing surface of a polishing pad with a conditioning element, comprising:

determining a distribution of waste matter across the planarizing surface of the polishing pad;

controlling the conditioning element to have a first abrading degree at a first location with a first amount of waste matter and a second abrading degree at a second location with a second amount of waste matter, the first abrading degree being greater than the second abrading degree and the first amount of waste matter being greater than the second amount of waste matter.

45. The method of claim 44 wherein the act of controlling comprises:

pressing the conditioning element against the planarizing surface of the polishing pad at a down-force;

moving the conditioning element across the planarizing surface of the polishing pad; and changing the down-force applied to the conditioning element as a function of the distribution of the waste matter accumulations.

46. The method of claim 45 wherein act of changing the down-force comprises increasing the down-force with increasing thicknesses of waste matter accumulations.

47. The method of claim 44 wherein the act of determining the distribution of waste matter comprises measuring a residence time of a substrate across the planarizing surface during planarization.

48. The method of claim 44 wherein the act of determining the distribution of waste matter comprises measuring a contour of the planarizing surface relative to a reference height for an exposed area on the planarizing surface without waste matter.

49. The method of claim 44 wherein the act of controlling comprises adjusting a residence time of the conditioning element on areas of the planarizing surface as a function of the determined distribution of the surface characteristic.

50. The method of claim 49 wherein the act of adjusting the residence time of the conditioning element comprises translating the conditioning element across the planarizing surface at different velocities as a function of the determined distribution of the surface characteristic.

51. A method of conditioning a planarizing surface of a polishing pad with a conditioning element, comprising:

evaluating the planarizing surface to determine a distribution of waste matter accumulations; and selectively adjusting an operating parameter of the conditioning element to increase a removal rate of material from the polishing pad with increased thicknesses of waste matter accumulations.

52. The method of claim 51 wherein the act of selectively adjusting comprises:

pressing the conditioning element against the planarizing surface of the polishing pad at a down-force;

moving the conditioning element across the planarizing surface of the polishing pad; and changing the down-force applied to the conditioning element as a function of the distribution of the waste matter accumulations.

53. The method of claim 52 wherein act of changing the down-force comprises increasing the down-force with increasing thicknesses of waste matter accumulations.

54. The method of claim 51 wherein the act of evaluating the planarizing surface comprises measuring a residence time of a substrate across the planarizing surface during planarization.

55. The method of claim 51 wherein the act of evaluating the planarizing surface comprises measuring a contour of the planarizing surface relative to a reference height for an exposed area on the planarizing surface without waste matter.

56. A method of removing waste matter from a planarizing surface of a polishing pad, comprising:

pressing a conditioning element against the planarizing surface of the polishing pad at a down-force;

moving the conditioning element across the planarizing surface of the polishing pad; and adjusting the down-force applied to the conditioning element as a function of a distribution of waste matter on the planarizing surface.

57. The method of claim 56 wherein the act of adjusting the down-force comprises increasing the down-force with increasing thicknesses of waste matter accumulations.

58. The method of claim 56, further comprising determining the distribution of the waste matter on the planarizing surface by measuring a residence time of a substrate across the planarizing surface during planarization.

59. The method of claim 56, further comprising determining the distribution of the waste matter on the planarizing surface by measuring a contour of the planarizing surface relative to a reference height for an exposed area on the planarizing surface without waste matter.

60. A method of conditioning a planarizing surface of a polishing pad for planarizing a substrate, comprising:

determining a representation of a distribution of waste matter across the planarizing surface of the polishing pad;

pressing a conditioning element against the planarizing surface of the polishing pad at a down-force;

translating the conditioning element across the planarizing surface; and controlling the down-force as a function of the distribution of waste matter, the down-force being a first magnitude over a first area with a first amount of waste matter and the down-force being a second magnitude over a second area with a second amount of waste matter, the first magnitude being greater than the second magnitude and the first amount of waste matter being greater than the second amount of waste matter.

61. The method of claim 60, further comprising determining the distribution of the waste matter by measuring a residence time of a substrate across the planarizing surface during planarization.

62. The method of claim 60, further comprising determining the distribution of the waste matter accumulations by measuring a contour of the planarizing surface relative to a reference height for an exposed area on the planarizing surface without waste matter.

63. A method of planarizing a substrate, comprising:

pressing the substrate against a polishing medium at a planarizing surface of a polishing pad;

moving the substrate relative to the polishing medium in a planarizing zone to remove material from the surface of the substrate, the moving step producing a distribution of waste matter accumulations across the planarizing surface of the polishing pad;

determining the distribution of waste matter accumulations across the planarizing surface of the polishing pad; and selectively removing material from the planarizing surface of the polishing pad according to the determined distribution of waste matter accumulations.

64. The method of claim 63 wherein the act of selectively removing material from the planarizing surface comprises adjusting a down-force applied to a conditioning element as a function of the distribution of the waste matter accumulations.

65. The method of claim 64 wherein the act of adjusting the down-force comprises increasing the down-force with increasing thicknesses of waste matter accumulations.

66. The method of claim 63 wherein the act of determining the distribution of the waste matter accumulations comprises measuring a residence time of the substrate across the planarizing surface during planarization.

67. The method of claim 63 wherein the act of determining the distribution of the waste matter accumulations comprises measuring a contour of the planarizing surface relative to a reference height for an exposed area on the planarizing surface without waste matter.

68. The method of claim 63 wherein the act of selectively removing material from the planarizing surface comprises controlling a conditioning element by adjusting a residence time of the conditioning element on areas of the planarizing surface as a function of the determined distribution of the surface characteristic.

69. The method of claim 68 wherein the act of adjusting the residence time of the conditioning element comprises translating the conditioning element across the planarizing surface at different velocities as a function of the determined distribution of the surface characteristic.

70. A conditioning system for conditioning polishing pads used to planarize substrates, comprising:

a carrier assembly having an arm positionable over a planarizing surface of a polishing pad and an actuator;

a conditioning element attached to the carrier assembly to be carried over a planarizing surface of a polishing pad, wherein the actuator controls an operating parameter of the conditioning element; and a controller operatively coupled to the actuator, the controller operating the actuator to adjust the operating parameter of the conditioning element as a function of a surface characteristic of the planarizing surface so that the condition element removes different amounts of material from different areas on the planarizing surface according to a distribution of the surface characteristic across the polishing pad.

71. The conditioning system of claim 70 wherein the actuator is a primary actuator that moves the conditioning element up and down with respect to the pad, the controller operating the primary actuator to adjust a down-force applied to the conditioning clement as a function of the distribution of the surface characteristic.

72. The conditioning system of claim 70 wherein the actuator is a rotational actuator that rotates the conditioning element, the controller operating the rotational actuator to adjust an angular velocity of the conditioning element as a function of the distribution of the surface characteristic.

73. The conditioning system of claim 70 wherein the actuator is a translational actuator that moves the conditioning element radially with respect to the pad, the controller operating the translational actuator to adjust an axial residence time of the conditioning element on the pad as a function of the distribution of the surface characteristic.

74. A planarizing machine, comprising:

a platen supporting a polishing pad;

a substrate carrier having a substrate holder positionable over a planarizing surface of the polishing pad, wherein at least one of the platen and the substrate holder is moveable to impart relative motion between the polishing pad and the substrate;

a carrier assembly having an arm positionable over a polishing pad and an actuator;

a conditioning element attached to the carrier assembly to be carried over a planarizing surface of a polishing pad, wherein the actuator is operated to control an operating parameter of the conditioning element; and a controller operatively coupled to the actuator, the controller operating the actuator to adjust the operating parameter of the conditioning element as a function of a surface characteristic of the planarizing surface so that the condition element removes different amounts of material from different areas on the planarizing surface according to a distribution of the surface characteristic across the polishing pad.

75. The conditioning system of claim 74 wherein the actuator is a primary actuator that moves the conditioning element up and down with respect to the pad, the controller operating the primary actuator to adjust a down-force applied to the conditioning element as a function of the distribution of the surface characteristic.

76. The conditioning system of claim 74 wherein the actuator is a rotational actuator that rotates the conditioning element, the controller operating the rotational actuator to adjust an angular velocity of the conditioning element as a function of the distribution of the surface characteristic.

77. The conditioning system of claim 74 wherein the actuator is a translational actuator that moves the conditioning element radially with respect to the pad, the controller operating the translational actuator to adjust an axial residence time of the conditioning element on the pad as a function of the distribution of the surface characteristic.

* * * * *

UNITED STATES PATENT AND TRADEMARK OFFICE

CERTIFICATE OF CORRECTION

PATENT NO. : 5,975,994
DATED : November 2, 1999
INVENTOR(S) : Sandhu et al.

It is certified that error appears in the above-identified patent and that said Letters Patent is hereby corrected as shown below:

| | | |
|---|---|---|
| Column 4, line 63 | "substrate 10" | should read - - substrate 110 - - |
| Column 5, line 8 | "PI" | should read - - $P_1$ - - |
| Column 6, line 42 | "substrate 10" | should read - - substrate 110 - - |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*